US006306314B1

(12) United States Patent
Martelli et al.

(10) Patent No.: US 6,306,314 B1
(45) Date of Patent: Oct. 23, 2001

(54) EVAPORABLE GETTER DEVICE WITH REDUCED ACTIVATION TIME

(75) Inventors: Daniele Martelli; Corrado Carretti, both of Milan; Luisa Mantovani, Lainate; Raffaello Lattuada, Cerro Maggiore; Giuseppe Urso, Seregno, all of (IT)

(73) Assignee: SAES Getters S.p.A. (IT)

( * ) Notice: Subject to any disclaimer, the term of this patent is extended or adjusted under 35 U.S.C. 154(b) by 0 days.

(21) Appl. No.: 09/015,965

(22) Filed: Jan. 30, 1998

(30) Foreign Application Priority Data

Jan. 30, 1997 (IT) ..... MI97A0177

(51) Int. Cl.[7] ..... H01J 7/18; H01J 35/20; H01K 1/56

(52) U.S. Cl. ..... 252/181.7; 252/181.6

(58) Field of Search ..... 252/181.1, 181.6, 252/181.7; 313/481, 547, 553, 561

(56) References Cited

U.S. PATENT DOCUMENTS

| | | | | |
|---|---|---|---|---|
| 4,077,899 | * | 3/1978 | van Gils | 252/181.4 |
| 4,127,361 | | 11/1978 | Hellier et al. | 417/48 |
| 4,323,818 | | 4/1982 | Madden et al. | 313/481 |
| 4,486,686 | | 12/1984 | della Porta | 313/481 |
| 4,504,765 | | 3/1985 | della Porta | 313/481 |
| 4,642,516 | | 2/1987 | Ward et al. | 313/481 |
| 4,717,500 | * | 1/1988 | Fisch et al. | 252/181.4 |
| 4,961,040 | | 10/1990 | della Porta et al. | 313/561 |
| 5,118,988 | | 6/1992 | della Porta | 313/561 |
| 5,508,586 | * | 4/1996 | Martelli et al. | 313/560 |

OTHER PUBLICATIONS

Patent Abstracts of Japan, vol. 15, No. 250 (E–1082) Jun. 26, 1991.

Patent Abstracts of Japan, vol. 7, No. 218 (E–200) Sep. 28, 1983.

Patent Abstracts of Japan, vol. 11, No. 271 (E–536) Sep. 3, 1987.

* cited by examiner

*Primary Examiner*—Joseph D. Anthony
(74) *Attorney, Agent, or Firm*—Oppenheimer Wolff & Donnelly, LLP

(57) ABSTRACT

An evaporable getter device containing a mixture of nickel and $BaAl_4$ is made to have a shorter barium evaporation time by using a mixture of nickel powders in which the particles of nickel have different morphologies and different specific areas.

11 Claims, 1 Drawing Sheet

EVAPORABLE GETTER DEVICE WITH REDUCED ACTIVATION TIME

BACKGROUND AND SUMMARY OF THE INVENTION

The present invention relates to an evaporable getter device that can be activated in less time.

It is known to use getter materials to help to maintain a vacuum for a long period of time. Kinescopes, including both conventional cathode-ray types and flat panel displays, use getter materials to fix trace gas that remain after initial evacuation or that result from out gassing of the materials used to make the kinescope.

The getter material most commonly used in kinescopes is metallic barium that is applied as a thin film on an inner wall of the kinescope. Devices known as evaporable getters apply the barium film after the kinescope has been evacuated and hermetically sealed. These getter devices comprise an open metal container that contains a compound of barium and aluminium, $BaAl_4$, in powder form, and nickel, Ni, in a powder form, in about equal ratios by weight. These types of getter devices are well known in the art as exemplified by U.S. Pat. No. 5,118,988, which is assigned to the assignee of this application.

Once evacuated and sealed, a coil located outside the kinescope induction-heats the getter device. This heating activates the getter device by causing the barium to evaporate. The metal in the container heats most rapidly and transfers heat to the powders that it contains.

The following reaction takes place when the temperature in the powders reaches about 800° C.:

$$BaAl_4+4Ni \rightarrow Ba+4NiAl \quad (I)$$

This reaction is strongly exothermic and heats the powders to a temperature of about 1200° C. The barium evaporates at this temperature and then sublimates on the walls of the kinescope to form a metallic film.

To obtain a good reactivity in the powder packet, the $BaAl_4$ compound is in a powder form in which the particles have a size that is smaller than about 250 $\mu$m. The nickel is also in a powder form and usually has a particle size that is smaller than 30 $\mu$m, although small amounts of the powder can have a somewhat larger particle size up to about 50 $\mu$m.

The morphology of the nickel powder differs among different manufacturers of getter devices. The same manufacturer may use types of nickel having different morphologies for different getter devices. However, no commercially available getter device is known to contain nickel particles having two or more different morphologies. The most common morphology for the nickel, as shown in FIG. 1, is one in which the nickel particles are essentially spherical in as much as the particles have a generally rounded shape with a relatively smooth surface. Another type of particle uses particles having a dendritic morphology as shown in FIG. 2 in which the shape of the particles is less regular and the surface of the particles is relatively nutated.

One way to characterize the morphologies of particles is by "specific area" which is the surface area per unit weight. This aspect of particle size can be measured using instruments that implement the Brunauer-Emmett-Teller (B.E.T.) theory. B.E.T. instruments, well known in the art of measuring and characterizing powders, provide a way to measure the surface area from absorbed gasses (e.g. $N_2$ at low temperature) as a function of pressure. Known nickel powders having a rounded or spherical morphology have B.E.T. specific areas in the ranges of 0.25–0.35 $m^2$/gram, whereas known dendritic particles have B.E.T specific areas in the ranges of 0.38–0.50 $m^2$/gram.

The amount of time needed to evaporate a predetermined amount of barium from the getter device, measured from the time when energy is first supplied to the device from the coil, is usually defined in the art as "Total Time". The phrase "Total Time", and its shortened form "TT", will be used in the following specification.

To function properly, modern color kinescopes may require a film containing as much as about 300 mg of barium. The current TT for evaporating such an amount of barium is about 40 seconds, or about 7.5 mg per second. The delay represented by the total time TT is a "bottle-neck" in the production of modern kinescopes. Therefore, there is a need in the art to have getter devices that can evaporate the same amount of barium in a shorter TT than can current getter devices.

One way to try to decrease the TT is to try increasing the power supplied by the coil. Another way is to try increasing the reactivity of the powders by decreasing their particle size. However, for the reasons explained below, neither of these solutions is practical.

Increasing the coil power with the current getter devices does not work because the powder container heats so quickly that there is not enough time to transmit the heat through the packet of powders. This rapid heating at the container causes the temperature of the powders directly against the container to become much higher than the temperature in the rest of the packet of powders. The reaction between $BaAl_4$ and Ni begins in the powders against the container, and the barium vapors produced in this area of the powders packet produces a vapor pressure having enough force to expel reaction fragments (principally $BaAl_4$, Ni and NiAl). This must be prevented so as not to compromise the working of the kinescope, and also has the potential to reduce the amount of barium being evaporated.

Decreasing the particle size of the powder can also cause an excessive, localized increase in the rate of the reaction between $BaAl_4$ and Ni next to the container and may also eject reaction fragments.

It is an objective of the present invention to provide an evaporable getter device that can be activated in less time without the disadvantages encountered in other systems. Specifically, it is an objective of the present invention to smoothly evaporate barium, without ejecting reaction fragments, more rapidly than previously possible using known evaporable getter devices.

The objectives of the present invention can be achieved according to the present invention using an evaporable getter device that comprises a metal container that contains the $BaAl_4$ powder and nickel powder in which the nickel powder is a mixture of particles that have two different morphologies. One of the morphologies of the nickel powder is essentially rounded or spherical and the second morphology is dendritic. The B.E.T. specific area of one of the morphologies of the particles can be in the range of 0.25–0.35 $m^2$/gram, whereas the B.E.T. specific areas of the other morphology of particle can be in the range of 0.38–0.50 $m^2$/gram. The ratio between the weight of the different forms of nickel morphologies may range from about 4:1 to 1:2.5. Stated another way, the different morphologies of nickel powders may be present in form of a mixture comprising at least 28 % of particles of a first morphology and at least 20% of particles having another morphology.

BRIEF DESCRIPTION OF THE DRAWINGS

The invention will be illustrated and described in detail below with reference to the drawings, in which.

DETAILED DESCRIPTION

Figure 1:
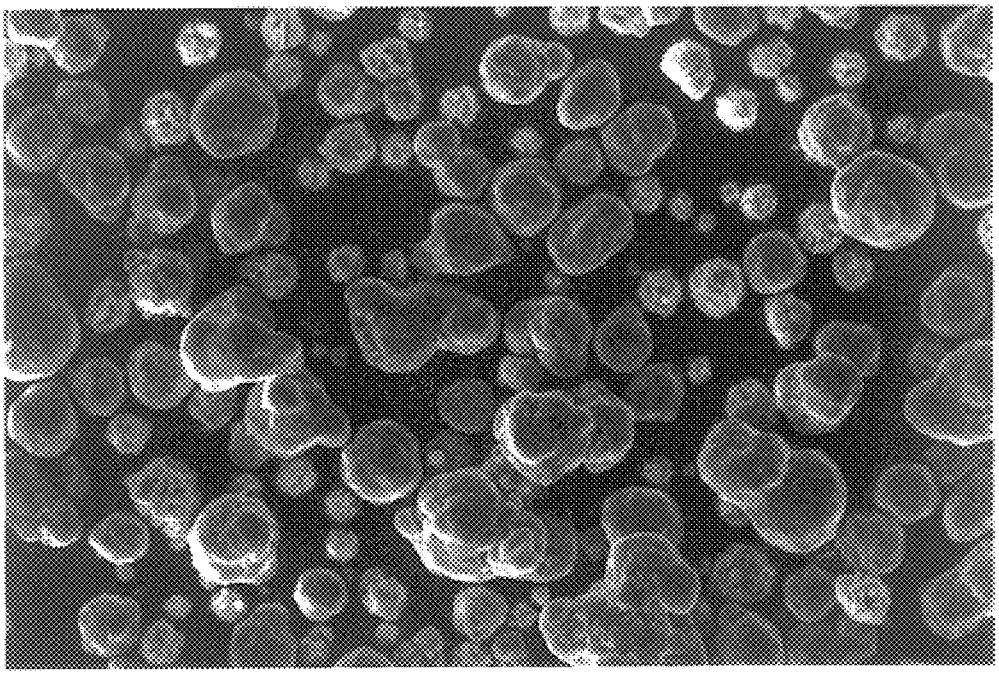
FIG. 1 is a reproduction of a microphotography of a sample of a nickel powder being of essentially spherical morphology.
Figure 2:
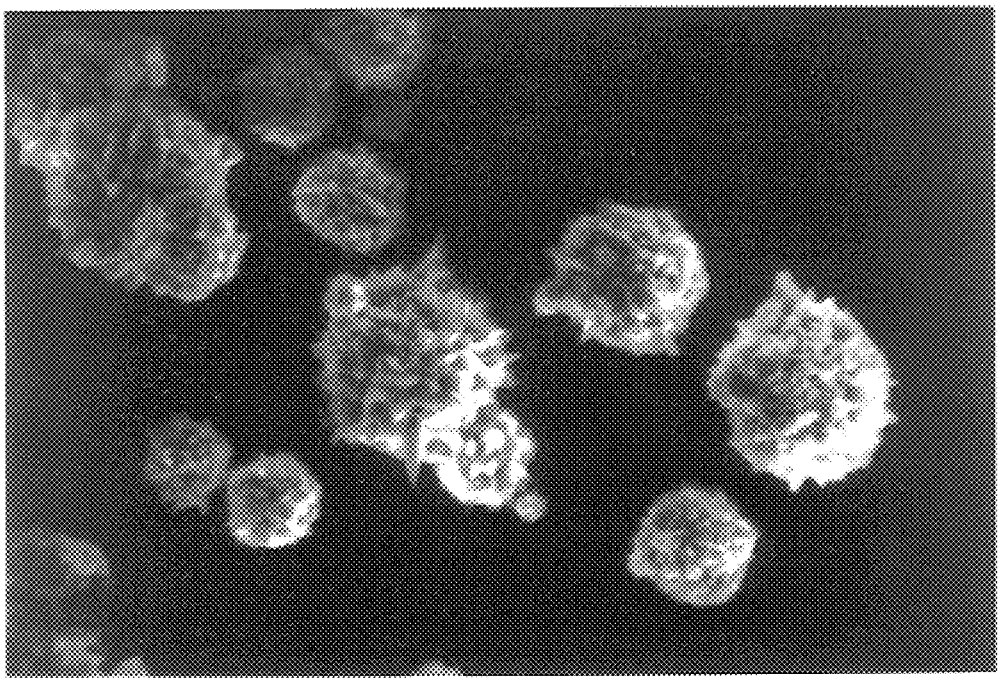
FIG. 2 is a reproduction of a microphotography, with the same enlargement as the reproduction in FIG. 1, of a sample of a nickel powder being of dendritic morphology.

It has been found that the use of mixtures of nickel powders of the two mentioned morphologies allows to reduce TT of about 25–30%, for the same amount of evaporated barium, without causing the problems involved with producing an exceedingly strong reaction mentioned above. In particular, it has been found that the reaction rate for vaporizing barium can be increased without ejecting reaction fragments from the getter device.

The weight ratio between the nickel particles of essentially spherical morphology and those of dendritic morphology may range from about 4:1 to 1:2.5 as a function of mass. It has been found that, at ratios higher than 4:1, the packet of powders comprising the $BaAl_4$ compound has a poor mechanical consistency that causes problems in producing getter devices. In contrast, ratios of less than 1:2.5 allow only a small reduction of TT. It is thought preferable to use mixtures in which the weight ratio between the two nickel morphologies is about 1:1.

Nickel has particle size smaller than about 50 $\mu$m, and preferably smaller than about 20 $\mu$m. It has further been found that best results are obtained when nickel of essentially spherical morphology has particles in a size ranging from about 10 to 18 $\mu$m. Samples of these particles typically have average specific areas in the range of 0.25–0.35 $m^2$/gram.

Nickel particles that have a dendritic morphology are commercially available. For example, the INCO Company of Sheridan Park, Ontario, Canada, offers commercial dendritic nickel having two different particle sizes under the catalogue numbers T-123 and T-128. Samples of these particles typically have specific areas in the range of 0.38–0.50 $m^2$/gram.

Nickel of essentially spherical morphology is commercially available and can be purchased from the INCO Company identified above. Alternatively, such nickel may be produced from nickel of any morphology and particle size slightly larger than that desired using the technique of "jet milling". This technique introduces a high-speed powder in a grinding chamber using a carrier gas flow. The powder particles are reduced in size, and their surface is rounded, by the collisions with other particles or by means of an obstruction that is interposed in their trajectory. The particles are subsequently classified to collect the fraction of desired particle size according to known techniques.

The particles of $BaAl_4$ used in practicing the present invention can have a particle size smaller than 250 $\mu$m. The weight ratio between nickel and $BaAl_4$ generally ranges between about 2:1 to 1:2, and a ratio of about 1:1 is generally used.

The metal container can be made from a variety of materials, such as NiCr or NiCrFe alloys. Using AISI 304 steel may be preferable since it combines good oxidation resistance and heat treatments strength with cold mechanical workability. The form of the metal container is not critical, and several metal containers are known such as shown in U.S. Pat. Nos. 4,127,361, 4,323,818, 4,486,686, 4,504,765, 4,642,516, 4,961,040 and 5,118,988, each of which is hereby incorporated by reference.

The invention will be further illustrated in the following examples. These non-limiting examples illustrate some embodiments intended merely to illustrate, to those skilled in the art, how to reduce the present invention to practice.

EXAMPLE 1

A series of samples of identical getter devices were prepared. Each getter device used an AISI 304 steel container having a diameter of 20 mm and a height of 4 mm and having its bottom shaped with relieves of 1 mm height as disclosed in U.S. Pat. No. 4,642,516. Each sample was prepared by filling the container with a homogeneous mixture of 660 mg of $BaAl_4$ powder having particle size smaller than 250 $\mu$m, 520 mg of nickel powder with the dendritic morphology of T-123 from the INCO Company, and 220 mg of nickel powder having average particle size 18 $\mu$m and being of essentially spherical morphology, obtained by grinding INCO T-123 nickel using the "jet milling" technique and sieving the resulting powders to collect the fraction of desired particle size. The total weight of nickel is 740 mg. The powders mixture is compressed in the container by means of a suitable punch. The samples are tested by inserting them one by one in a glass measure chamber connected to a pump system, by evacuating the chamber and carrying out an evaporation test according to the methodology described in the ASTM F 111-72 standard. Each sample is heated by radio frequencies with such a power that evaporation begins 10 seconds after heating has begun. The tests are different from one another in heating time, ranging in the different tests from 20 to 45 seconds. Once each test is ended, the amount of evaporated barium is measured, and from this data series a curve of barium yield as a function of heating time can be drawn. In Table 1, the weight ratio between essentially spherical nickel (in Table indicated as Nis) and dendritic nickel (indicated as NiD) is shown, as well as the TT value necessary to evaporate from the devices a barium amount of 300 mg.

EXAMPLE 2

The tests of Example 1 were repeated with a series of samples of identical getter devices. A homogeneous mixture was formed from 660 mg of $BaAl_4$ powder having particle size smaller than 250 $\mu$m, 370 mg of nickel powder being of essentially spherical morphology obtained by "jet milling" as described in Example 1, and 370 mg of INCO T-123 nickel, for a total nickel weight of 740 mg. The weight ratio between the two nickel forms and the time necessary to evaporate 300 mg of barium are shown in Table 1.

EXAMPLE 3

The tests of Example 1 were repeated with a series of identical getter devices. A homogeneous mixture was formed from 660 mg of $BaAl_4$ powder having particle size smaller than 250 $\mu$m, 590 mg of nickel powder being of essentially spherical morphology obtained by "jet milling" as described in Example 1, and 150 mg of INCO T-123 nickel, for a total nickel weight of 740 mg. The weight ratio between the two nickel forms and the time necessary to evaporate 300 mg of barium are shown in Table 1.

EXAMPLE 4 (Comparative)

The tests of Example 1 are repeated with a series of identical getter devices. A homogeneous mixture was formed from 660 mg of $BaAl_4$ powder having particle size smaller than 250 $\mu$m, and 740 mg of T-123 nickel powder.

The time necessary to evaporate 300 mg of barium is reported in Table 1.

TABLE 1

| EXAMPLE | $Ni_S$: $Ni_D$ | Total Time (seconds) |
|---|---|---|
| 1 | 1:2.36 | 36 |
| 2 | 1:1 | 30 |
| 3 | 3.93:1 | 29 |
| 4 | / | 40 |

The results shown in Table 1 confirm that, other conditions being the same, using mixtures of nickel powders of essentially spherical morphology and of dendritic morphology reduces the Total Time (TT) required to evaporate the barium compared to using nickel having a single morphology. Furthermore, these powders mixtures allow the powders packet to have good mechanical properties which improves the production of getter devices.

The principles, preferred embodiments and modes of operation of the present invention have been set forth in the foregoing specification. This specification, including examples, should be interpreted as illustrating the present invention and not as restricting it. The foregoing disclosure is not intended to limit the range of equivalent structure available to a person of ordinary skill in the art in any way, but rather to expand the range of equivalent structures in ways not previously thought of. For example, differences in the morphology of the nickel has herein been equated with differences in the specific surface area of the nickel; differences in either specific surface area or in overall particle shape therefore may be considered to be equivalent. Numerous variations and changes can be made to the foregoing illustrative embodiments without departing from the scope and spirit of the present invention as set forth in the appended claims.

We claim:

1. An evaporable getter device, comprising:

a metal container containing a powder mixture;

the powder mixture comprising of $BaAl_4$; and the powder mixture further comprising nickel (Ni) powder having a mixture of particles of at least first and second morphologies, the first morphology being essentially spherical and the second morphology being dendritic;

wherein the nickel particles of the first morphology have an average specific area of between 0.25 m2/gram and 0.35 m2/gram, and the nickel particles of the second morphology have an average specific area of between 0.38 m2/gram and 0.50 m2/gram.

2. An evaporable getter device as claims in claim 1, wherein the weight ratio between the first and second nickel morphologies is between 4:1 and 1:2.5.

3. A evaporable getter device as claimed in claim 1, wherein the ratio between the first and second nickel morphologies is 1:1.

4. An evaporable getter device as claimed in claim 1, wherein the $BaAl_4$ has an average particle size of less than 250 $\mu$m.

5. An evaporable getter device as claimed in claim 1, wherein the nickel and $BaAl_4$ have a ratio by weight of between 2:1 and 1:2.

6. An evaporable getter device as claimed in claim 1, wherein the nickel and $BaAl_4$ have a ratio by weight of 1:1.

7. An evaporable getter device as claimed in claim 1, wherein the weight ratio between the first and second nickel morphologies is between 4:1 and 1:2.5.

8. An evaporable getter device as claimed in claim 7, wherein the ratio between the first and second nickel morphologies is 1:1.

9. An evaporable getter device as claimed in claim 1, wherein at least one of the first or second nickel morphologies has an average particle size of less than 50 $\mu$m.

10. An evaporable getter device as claimed in claim 9, wherein at least one of the first or second nickel morphologies has an average particle size of less than 20 $\mu$m.

11. An evaporable getter device as claimed in claim 9, wherein the first morphology of nickel has a spherical morphology and an average particle size ranging from 10 to 18 $\mu$m.

* * * * *